US008061375B2

(12) United States Patent
Ma

(10) Patent No.: US 8,061,375 B2
(45) Date of Patent: Nov. 22, 2011

(54) ADJUSTABLE RIB CONNECTORS

(75) Inventor: Oliver Joen-an Ma, Arcadia, CA (US)

(73) Assignee: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 12/554,802

(22) Filed: Sep. 4, 2009

(65) Prior Publication Data

US 2010/0059094 A1 Mar. 11, 2010

(30) Foreign Application Priority Data

Sep. 5, 2008 (CN) ..... 2008 2 0163974

(51) Int. Cl.
*A45B 25/06* (2006.01)
*A45B 25/02* (2006.01)

(52) U.S. Cl. ..... 135/28; 135/29; 135/31; 135/98; 403/171; 403/217

(58) Field of Classification Search ..... 135/16, 135/29–32, 98, 135, 147, 120.3; 403/170–173, 403/220–223, 295, 406; 248/317
See application file for complete search history.

(56) References Cited

U.S. PATENT DOCUMENTS

| | | | | |
|---|---|---|---|---|
| 331,231 | A | 11/1885 | Folger | |
| 501,089 | A | 7/1893 | Lichtenstein | |
| 620,815 | A | 3/1899 | Warren | |
| 880,534 | A | 3/1908 | Hoyt | |
| 897,026 | A | 8/1908 | Seitzinger | |
| 928,169 | A | 7/1909 | Bardon | |
| 941,952 | A | 11/1909 | Riehl | |
| 947,790 | A | 2/1910 | Carter | |
| 959,127 | A * | 5/1910 | Edwards | 135/31 |
| 1,001,076 | A | 8/1911 | Redford | |
| 1,107,415 | A | 8/1914 | Drohan | |
| 1,264,075 | A | 4/1918 | Hout | |
| 1,469,495 | A | 10/1923 | Bunker | |
| 2,207,043 | A | 7/1940 | Weiss et al. | |
| 2,321,495 | A | 6/1943 | Levin | |
| 2,336,116 | A | 12/1943 | Morando | |
| 2,385,575 | A | 9/1945 | Isler | |
| 2,635,616 | A | 4/1953 | Haydu | |

(Continued)

FOREIGN PATENT DOCUMENTS

| | | |
|---|---|---|
| CA | 1269018 | 5/1990 |

(Continued)

OTHER PUBLICATIONS

Treasure Garden, 2010 Products Catalog, pp. 20 and 60.

(Continued)

*Primary Examiner* — Winnie Yip
(74) *Attorney, Agent, or Firm* — Knobbe, Martens, Olson & Bear LLP

(57) ABSTRACT

The present inventions relate generally to connectors for interconnecting members of shade structures (e.g. umbrellas and pavilions), such as support ribs and hubs. The connectors can be incorporated or attached to support ribs of shade structures to enable the support ribs to extend from the hubs at various angles to accommodate different shaped canopies. The connectors include an adjustable portion that enables the support ribs to extend to desired points on the periphery of the canopy at an angle that deviates from the angle of the hub channels, which are disposed around the periphery of the hubs.

9 Claims, 14 Drawing Sheets

U.S. PATENT DOCUMENTS

| | | | | | |
|---|---|---|---|---|---|
| 2,762,383 | A | | 9/1956 | Wittman | |
| 2,796,073 | A | | 6/1957 | Wittman | |
| 2,860,647 | A | | 11/1958 | Negri | |
| 2,914,154 | A | | 11/1959 | Russell | |
| 3,177,882 | A | | 4/1965 | Militano | |
| 3,330,582 | A | * | 7/1967 | Morris | 403/182 |
| 3,462,179 | A | | 8/1969 | Hinkle | |
| 3,557,809 | A | | 1/1971 | Vazquez et al. | |
| 3,643,673 | A | | 2/1972 | Weber | |
| 3,704,479 | A | | 12/1972 | Whitaker | |
| 4,201,237 | A | | 5/1980 | Watts et al. | |
| 4,368,749 | A | | 1/1983 | Lindler et al. | |
| 4,369,000 | A | * | 1/1983 | Egnew | 403/13 |
| 4,673,308 | A | * | 6/1987 | Reilly | 403/172 |
| 4,750,509 | A | | 6/1988 | Kim | |
| D320,111 | S | | 9/1991 | Ma | |
| 5,056,291 | A | * | 10/1991 | Leung | 52/637 |
| 5,188,137 | A | | 2/1993 | Simonelli | |
| 5,193,566 | A | | 3/1993 | Chen | |
| 5,328,286 | A | | 7/1994 | Lee | |
| 5,433,233 | A | | 7/1995 | Shiran et al. | |
| 5,445,471 | A | * | 8/1995 | Wexler et al. | 403/220 |
| 5,738,129 | A | | 4/1998 | Vogt | |
| 5,797,613 | A | * | 8/1998 | Busby | 280/284 |
| 6,076,540 | A | | 6/2000 | You | |
| 6,095,169 | A | | 8/2000 | Lin et al. | |
| 6,311,706 | B1 | | 11/2001 | Sato | |
| 6,314,976 | B1 | | 11/2001 | Clarke | |
| 6,332,657 | B1 | * | 12/2001 | Fischer | 312/111 |
| 6,345,637 | B1 | | 2/2002 | Ko | |
| 6,374,840 | B1 | | 4/2002 | Ma | |
| 6,643,889 | B1 | | 11/2003 | Kotlarski | |
| 6,701,946 | B2 | | 3/2004 | You | |
| 6,705,335 | B2 | | 3/2004 | You | |
| 6,758,228 | B1 | | 7/2004 | You | |
| 6,814,093 | B2 | | 11/2004 | You | |
| 7,178,535 | B2 | | 2/2007 | Eder | |
| 7,574,777 | B1 | * | 8/2009 | Fuller et al. | 16/436 |
| 2004/0123891 | A1 | | 7/2004 | Ma | |
| 2005/0115599 | A1 | | 6/2005 | You | |
| 2006/0124160 | A1 | * | 6/2006 | Lee | 135/28 |
| 2007/0172310 | A1 | | 7/2007 | Yang et al. | |
| 2009/0056776 | A1 | | 3/2009 | Ma | |
| 2009/0126769 | A1 | * | 5/2009 | Hoogendoorn | 135/98 |

FOREIGN PATENT DOCUMENTS

| | | | |
|---|---|---|---|
| FR | 002650491 | A1 | 2/1991 |
| JP | 61131921 | | 8/1986 |
| KR | 100851744 | | 8/2008 |
| WO | WO 2005/023042 | | 3/2005 |

OTHER PUBLICATIONS

EPO Extended Search Report dated Apr. 5, 2011 for European Patent No. 09252140.0, filed Sep. 7, 2009.

* cited by examiner 11
13
16
50
50
50
26
27
28

ADJUSTABLE RIB CONNECTORS

CROSS-REFERENCE TO RELATED APPLICATIONS

The present application claims the priority benefit under 35 U.S.C. §119(a)-(d) to Chinese Patent Application No. 200820163974.1, filed Sep. 5, 2008, the disclosure of which is incorporated by reference herein in its entirety.

BACKGROUND

1. Field of the Inventions

The present inventions relate generally to interconnecting joints of shade structures (e.g. umbrellas and portable pavilions) having frame members and hubs, and to uniquely configured connectors that can be incorporated into frame members of such structures to enable the frame members to extend from the hubs at various angles to accommodate different shaped canopies.

2. Description of the Related Art

There are a variety of shade structures that are often very useful for providing protection from the environment, such as from the sun or rain. Large outdoor umbrellas and pavilions can be used to provide shade for persons sitting around tables. The shade structures are sometimes made with an oblong or asymmetrical shape. For example, an oval or rectangular shaped canopy can be useful for a rectangular table where the table is longer than it is wide. Other applications are best served by round, square or other shaped canopies that are not oblong. Different shaped canopies require different components arrangements, which have required numerous single-application components.

Pavilions and umbrellas usually include a frame and a canopy that is supported by the frame. In regards to umbrellas, the frame can include a hub coupled toward one end of a pole, another hub or runner slideably coupled to the pole, a support rib structure comprising a plurality of canopy ribs and a plurality of spreader ribs, and a canopy disposed across the plurality of canopy ribs. The plurality of support ribs can be coupled to the hub toward one end of the support ribs and extend to a perimeter of the canopy. The plurality of spreader ribs can be connected toward one end with the runner and with the support ribs toward the other end. The umbrella can be deployed or collapsed by sliding the runner up or down the pole, respectively.

In some designs, a hub comprises hub channels that are disposed around the hub periphery that extend in an angular direction away from the center of the hub. Usually a plurality of ribs are coupled to the channels and extend at the same angular direction determined by the angle of the hub channels. The ribs extend and connect to points along the periphery of the canopy. Depending on the shape and size of the canopy, the hub channels are disposed at various angles relative to each other. For example, an umbrella with a circular canopy shape has hub channels that are spaced around the periphery of a hub at equal angles from each other.

On the other hand, when the umbrella comprises an oblong canopy shape, the hub channels are spaced around the hub periphery at different angles from each other. Thus, a hub for an umbrella with a non-oblong canopy comprising hub channels that are spaced at equal angles from each other around the hub periphery would not be suitable for use in an umbrella with an oblong canopy.

Thus, different hubs with specific angular spacing between hub channels that correlate to the shape of the canopy must be specifically manufactured for each canopy shape.

SUMMARY OF THE INVENTIONS

An aspect of at least one of the embodiments disclosed herein is the realization that adjustable angle rib connectors can be used to connect a same hub design with various oblong and non-oblong canopies. Such novel connectors can be particularly advantageous for reducing manufacturing costs, inventory requirements and for enhancing interchangeability of parts.

Therefore, some embodiments of a connector are disclosed herein that can facilitate the connection of a rib of a structure, such as an umbrella, to a canopy, a hub and/or another rib of the structure. The connector and the rib can be integrally formed from a continuous piece of material. Alternatively, the connector can be capable of being connected to one or both ends of the rib to facilitate the connection of the rib to another rib or the hub. Furthermore, it is contemplated that the connector can be made of one or a combination of any variety of available materials. For example, the connector can be made out of a durable plastic, metal, composites, or various combinations thereof.

In some embodiments, the connector can comprise an umbrella having an open, in use, position and a closed, stowed, position, the umbrella comprising a pole and a hub having a periphery extending around the pole, the hub periphery having formed therein a plurality of channels that are spaced at the same angle from one another around the hub periphery. The umbrella can also comprise a canopy having a periphery that includes at least some rib connection points located at different distances from the pole in the open position. Also, the umbrella can comprise a plurality of ribs, each being mounted in a respective hub channel and extending from the hub channels to the periphery of the canopy. The plurality of ribs have a first group extending from the hub at said angle and a second group being configured to deviate from the angle of the hub channels, so that they can extend toward said rib connection points on the periphery of the canopy.

In some embodiments, the umbrella can comprise a connector capable of connecting a structural rib of an umbrella to a hub or other rib of the umbrella. The connector can comprise a first portion configured to couple with an umbrella rib, a second portion opposite the first portion configured to couple with the hub or runner, and a flexible portion disposed between the first and second portions. A first longitudinal axis can extend normal to an end of the first portion and a second longitudinal axis can extend normal to an end of the second portion. The flexible portion can comprise at least one channel disposed transversely across a width of one side of the connector, the channel having a depth extending transversely from an opening of the channel to a base end opposite the opening. The connector is adapted by way of the channel or other structure to permit the first longitudinal axis to be disposed at an angle relative to the second longitudinal axis. In some embodiments, the connector is adapted to permit the first longitudinal axis to be disposed relative to the second longitudinal axis at any angle within a range of angles.

In some embodiments, an umbrella rib angle adjusting device can comprise a first portion configured to couple with an umbrella rib and a second portion configured to couple with an umbrella hub. The main body can be configured to permit the umbrella rib to attach to a hub channel and extend from the hub channel at an angle that deviates from a hub channel angle.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION

Figure 1:
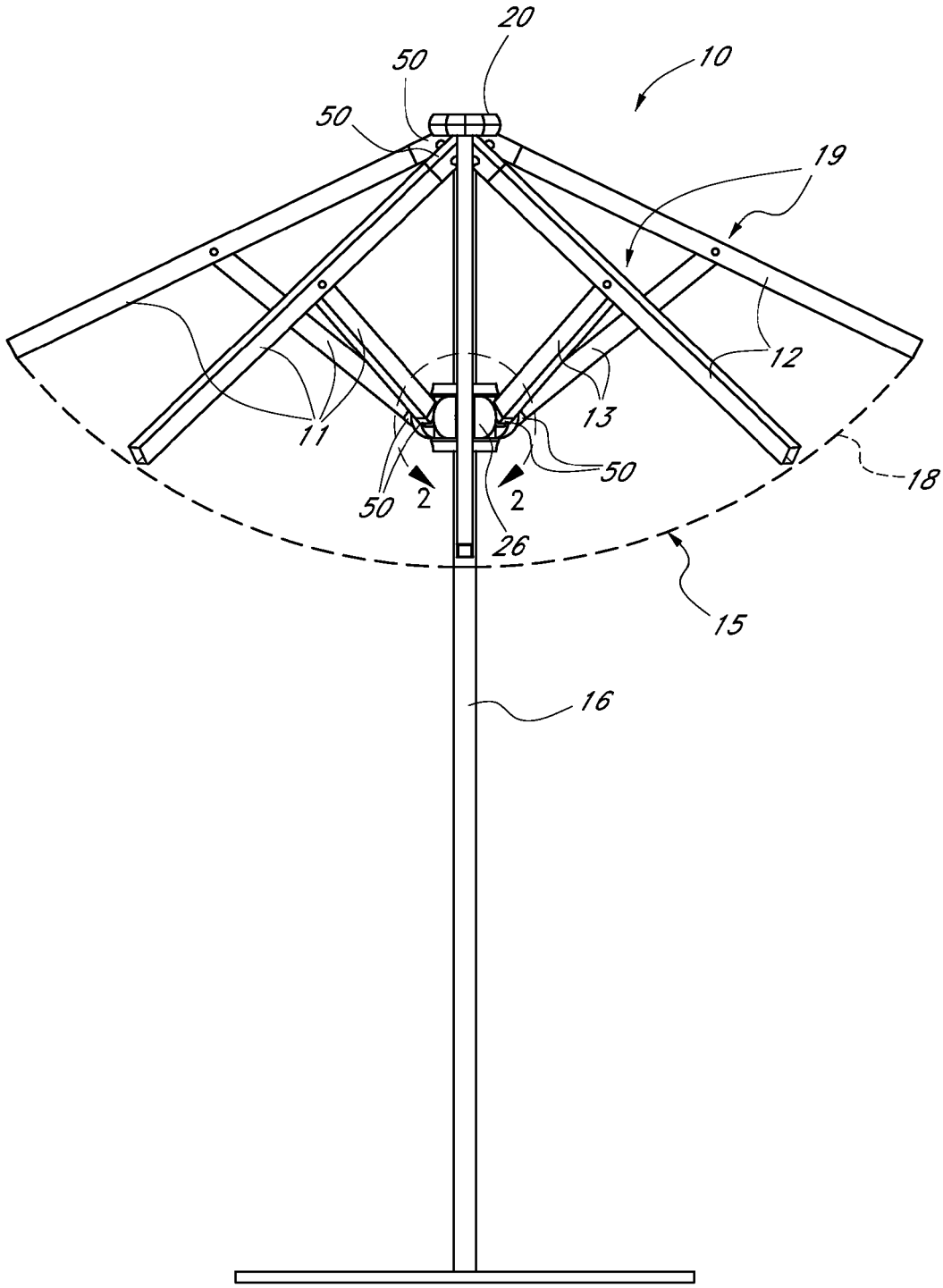
FIG. 1 is a side view of an umbrella having an embodiment of the connectors and also illustrating a pole, hub and ribs.
Figure 2:
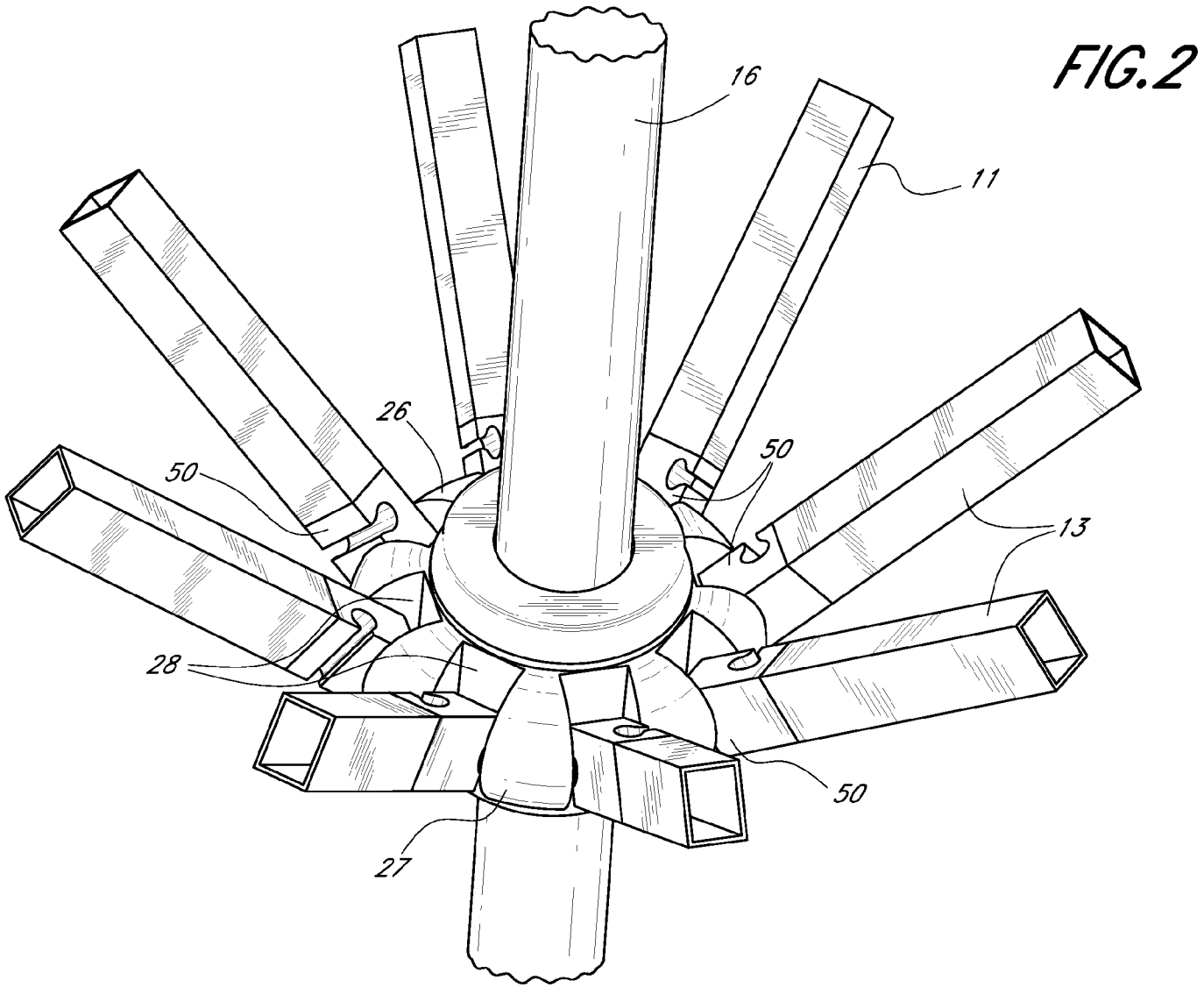
FIG. 2 is a close-up top perspective view of detail 2-2 in FIG. 1, illustrating the connectors coupled to the hub and ribs.

In accordance with an embodiment of the present inventions, as illustrated in FIGS. 1 and 2, there are provided various configurations of a connector that can be used with a structure, such as an umbrella or pavilion, to couple support ribs with a hub or runner and provide a desired angle between the support ribs and hub or runner. As described in greater detail herein, the connector can incorporate various features such that a same hub design can be utilized in various umbrellas or pavilions having an oblong canopy or a non-oblong canopy. As a result, one hub configuration can be used with multiple distinct shaped umbrellas, as discussed further below. This advantageously enables a reduction in inventory of specialized components where both umbrella configurations are being constructed.

FIG. 1 illustrates a side view of an embodiment of an umbrella 10 comprising a pole 16. A hub 20 is fixed to an end of the pole 16 and another hub, referred to herein as a runner 26, is slideably coupled to the pole 16 such that the runner 26 can move linearly along the pole 16. A plurality of support ribs 11 are attached to the hub 20 and the runner 26. The support ribs 11 can comprise of canopy ribs 12 or spreader ribs 13. The canopy ribs 12 are attached at one end to the hub 20 and at the other end toward a periphery 18 of a canopy 15, shown in dashed lines in FIG. 1. The spreader ribs 13 are attached at one end to the runner 26 and attached at the other end to a middle portion 19 of the canopy ribs 12. In some embodiments, a plurality of connectors 50 connects the plurality of canopy ribs 12 to the hub 20. In other embodiments, a plurality of connectors 50 connects the plurality of spreader ribs 13 to the runner 26. A plurality of connectors 50 can interconnect the plurality of canopy ribs 12 to the hub 20 and the plurality of spreader ribs 13 to the runner 26. The canopy 15 can be circular, triangular, square, polygonal, or any other shape. In some embodiments, the canopy 15 can have a shape that is oblong.

In this application, non-oblong canopies include canopies with shapes that are symmetric about at least two axes and have equilateral sides. Some examples of non-oblong shapes are circles, squares, equilateral triangles and other equilateral polygons. An oblong canopy can be configured in any shape that comprises at least one side of different length than another side, such as for example rectangles, ovals, elongate polygons and some triangles such as isosceles triangles. In another sense, an oblong canopy can be one in which at least two transverse axes are defined that are of different lengths, such as major and minor axes in an oval shaped canopy. A non-oblong canopy can be one in which at least two transverse axes are defined that are of the same or approximately the same lengths.

FIG. 2 is a close-up top perspective view of an assembly including the runner 26 and a plurality of spreader ribs 13 with connectors 50 connected thereto. The runner 26 comprises a runner periphery 27 disposed around the pole 16. The runner periphery 27 comprises a plurality of runner channels 28 that are spaced at equal angles from one another along the runner periphery 27. The plurality of connectors 50 and spreader ribs 13 are coupled with the runner 26 at respective runner channels 28. The spreader ribs 13 extend from the runner channels 28 to the canopy ribs 12. Although described with reference to the runner 26 and spreader ribs 13, the preceding description can also apply to the hub 20 and canopy ribs 12.

Note that in the illustrated embodiments, the canopy ribs 12 extend to locations on the periphery of the canopy 15 and the spreader ribs 13 extend to the canopy ribs 12. Thus, the spreader ribs 13 can extend from the runner 26 at generally the same angle relative to each other that the canopy ribs 12 extend from the hub 20 relative to each other.

Figure 3:
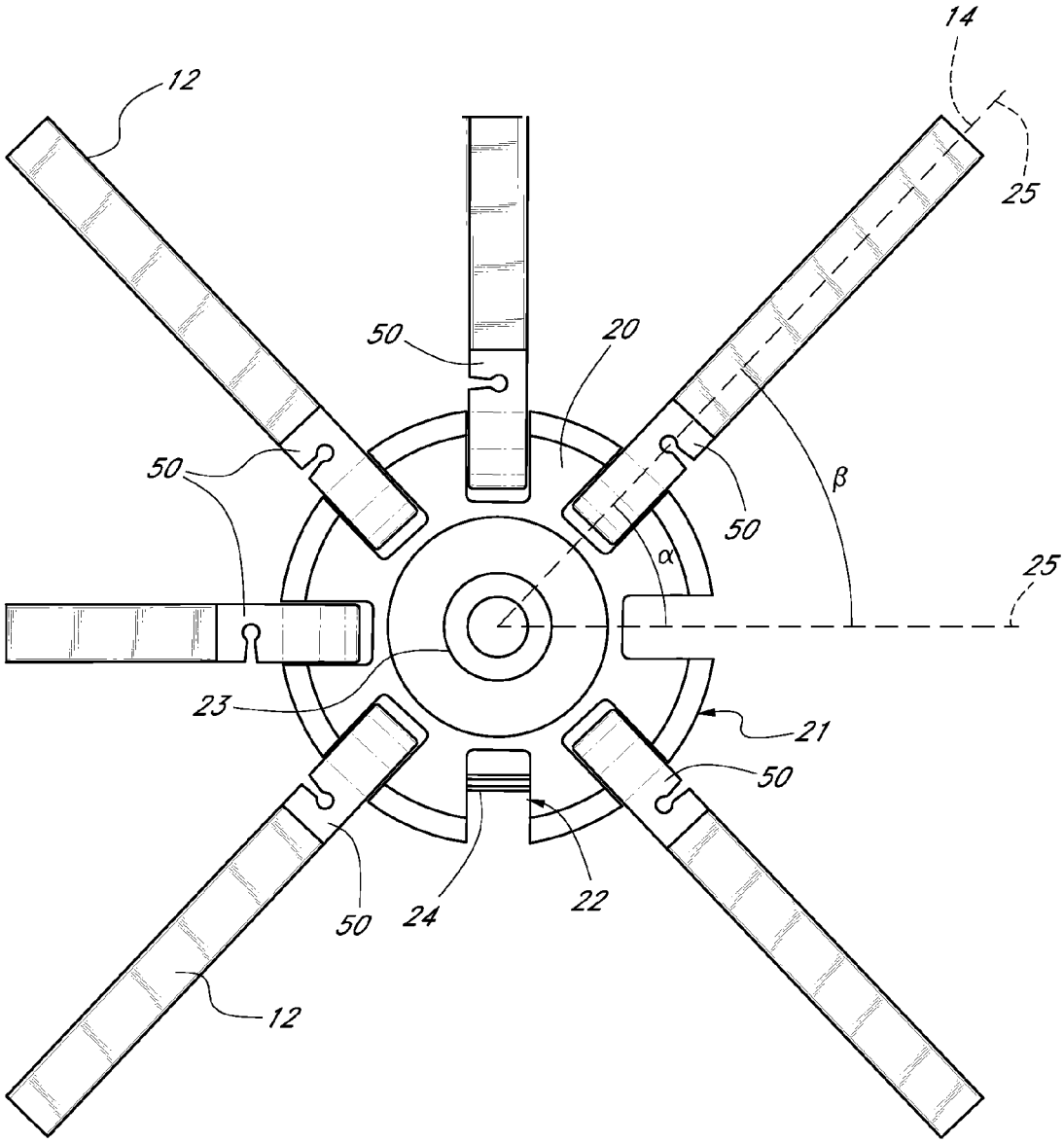
FIG. 3 is a bottom view of an upper portion of an umbrella having a non-oblong canopy, illustrating an embodiment of the connectors coupled to a hub and ribs.
Figure 4:
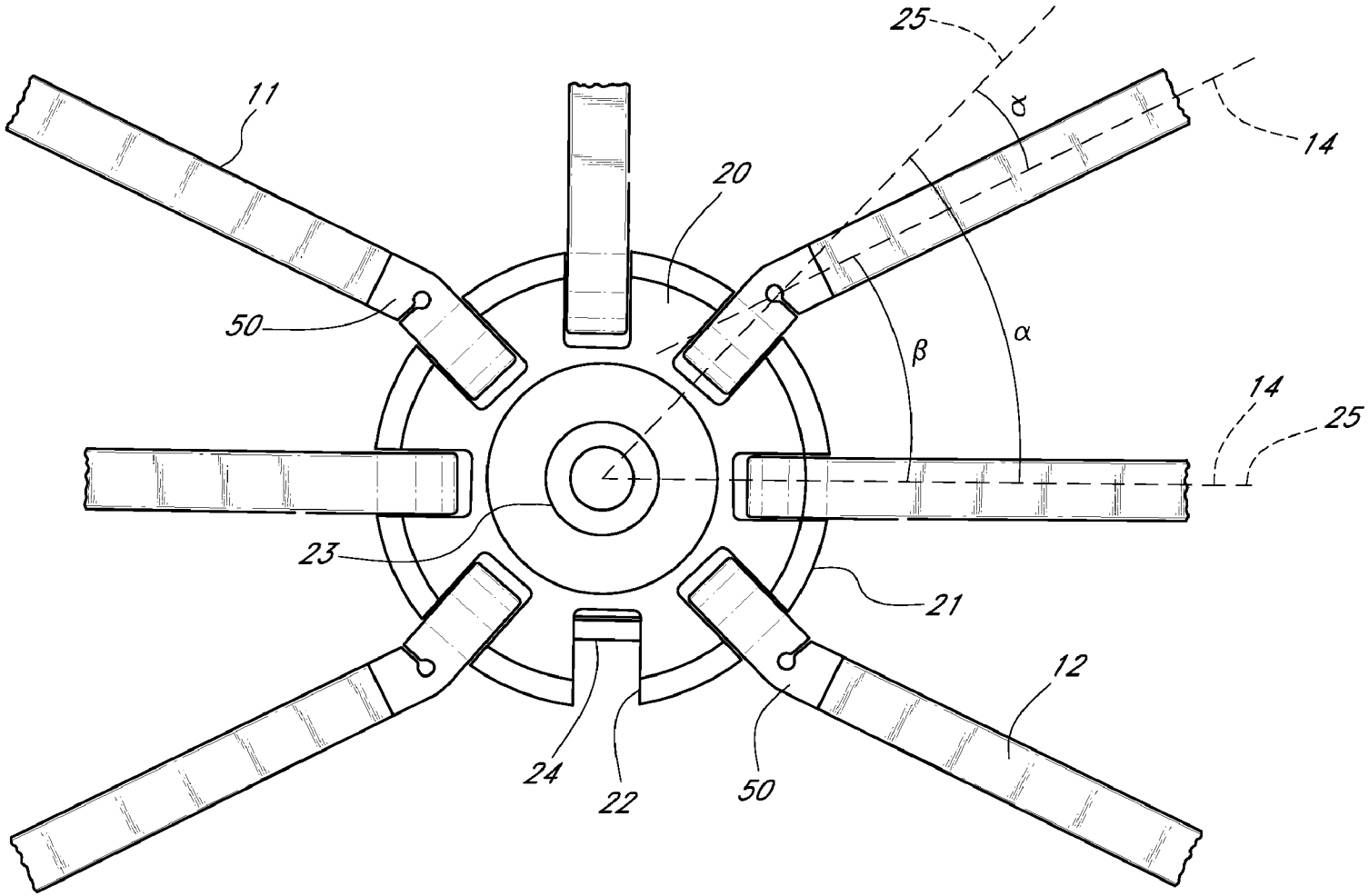
FIG. 4 is a bottom view of an umbrella having an oblong canopy, illustrating an embodiment of the connectors coupled to a hub and ribs

Referring now to FIGS. 3 and 4, further details of the hub 20 and connectors 50 are illustrated. In the following description, reference is made to the hub 20 and canopy ribs 12. However, the description can apply correspondingly to the runner 26 and spreader ribs 13. The hub 20 includes a central aperture 23 wherein the pole 16 can be received. Further, the hub 20 includes a plurality of hub channels 22 disposed around the hub periphery 21 and extending radially outwardly from a center of the hub 20. The hub channels 22 are spaced around the hub periphery 21 at equal angles from one another.

Support ribs 11, or more specifically canopy ribs 12, can be coupled with the hub channels 22 by the connectors 50 and can extend toward the periphery of the canopy 15. Preferably, the hub 20 includes at least three hub channels 22 to accommodate at least three canopy ribs 13 in order to provide sufficient support for the canopy 15.

FIG. 3 is a bottom view of an embodiment of an upper portion of an umbrella having a non-oblong canopy, for example a square canopy. The hub 20 comprises hub channels 22 that extend along longitudinal axes 25 and that are defined within bight portions of the hub that extend inwardly from an outer portion of the hub 20. The longitudinal axes 25 extend along the centerline of the hub channels 22. In the illustrated embodiment, the hub 20 comprises eight hub channels 22. In other embodiments, the hub 20 can include any number of hub channels 22. The hub channels 22 can be spaced at equal angles between each other around the hub periphery 21, such as illustrated in the embodiment of FIG. 3. In an embodiment, the hub channels 22 are disposed at an angle $\alpha$ between the longitudinal axes 25 of the hub channels 22 of approximately 45 degrees.

Figure 3A:
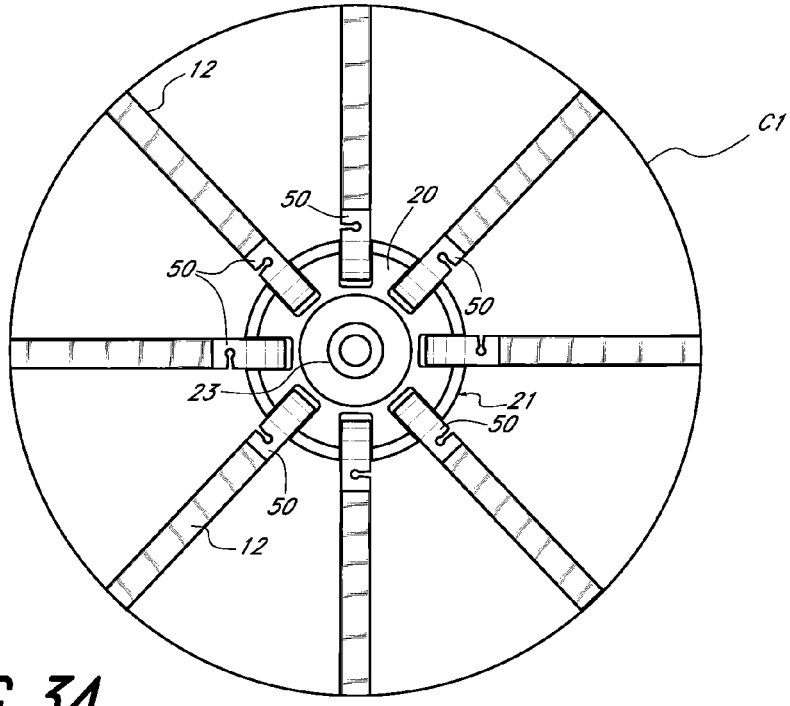
FIG. 3A is a bottom view of an upper portion of an umbrella illustrating an embodiment of the connectors in cooperation with a circular canopy.
Figure 3B:
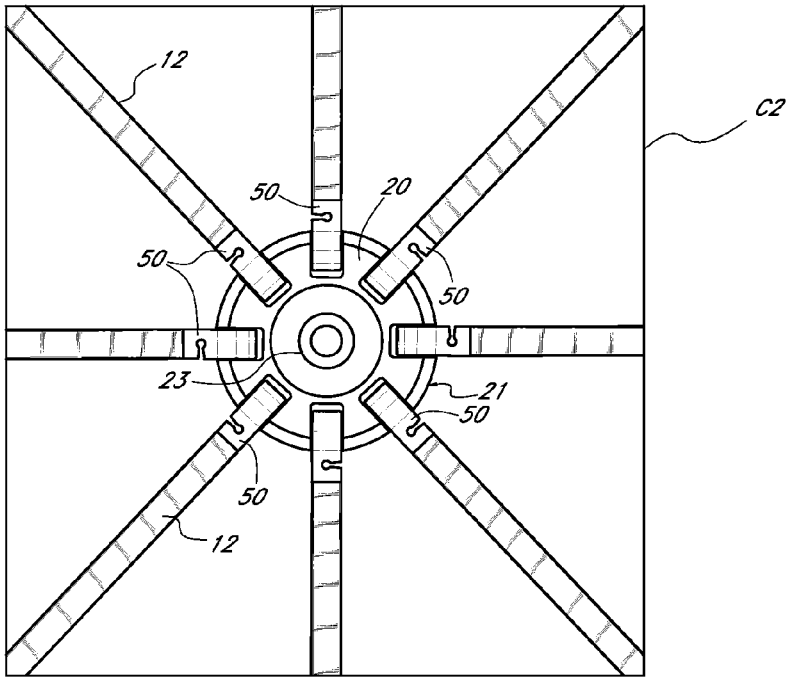
FIG. 3B is a bottom view of an upper portion of an umbrella illustrating an embodiment of the connectors in cooperation with a square canopy.

The canopy ribs 12 can have longitudinal axes 14 that extend in the same direction as the longitudinal axes 25 of the hub channels 22. In other words the longitudinal axes 14 of the canopy ribs 12 can be collinear or parallel to the longitudinal axes 25 of the hub channels 22. The angle between the longitudinal axes 14 of adjacent canopy ribs 12 is illustrated in FIGS. 3 and 4 as angle $\beta$. In some non-oblong umbrella configurations, $\beta$ is equal to angle $\alpha$. In some arrangements, where the longitudinal axes 14 of the canopy ribs 12 and hub channels 22 are collinear $\beta$ is equal to angle $\alpha$. In the illustrated embodiment of FIG. 3, the angle $\beta$ is 45 degrees. In some embodiments having a square canopy C2, such as illustrated in FIG. 3B, eight equiangularly separated canopy ribs 12 can extend to the corners and the midpoints of the sides of the square canopy. In other embodiments having a differently shaped non-oblong canopy, such as the circular canopy C1 illustrated in FIG. 3A, the canopy ribs 12 can extend toward locations along the periphery of the canopy 15 that are equally distanced from each other.

Figure 4B:
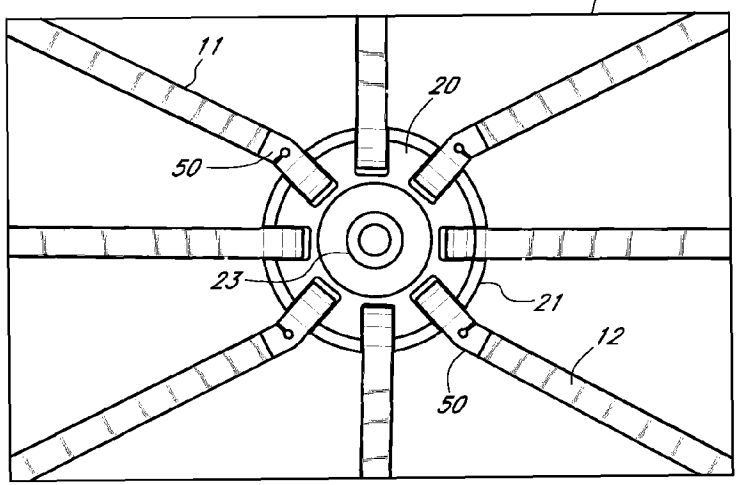
FIG. 4B is a bottom view of an upper portion of an umbrella illustrating an embodiment of the connectors in cooperation with a rectangular canopy.
Figure 4A:
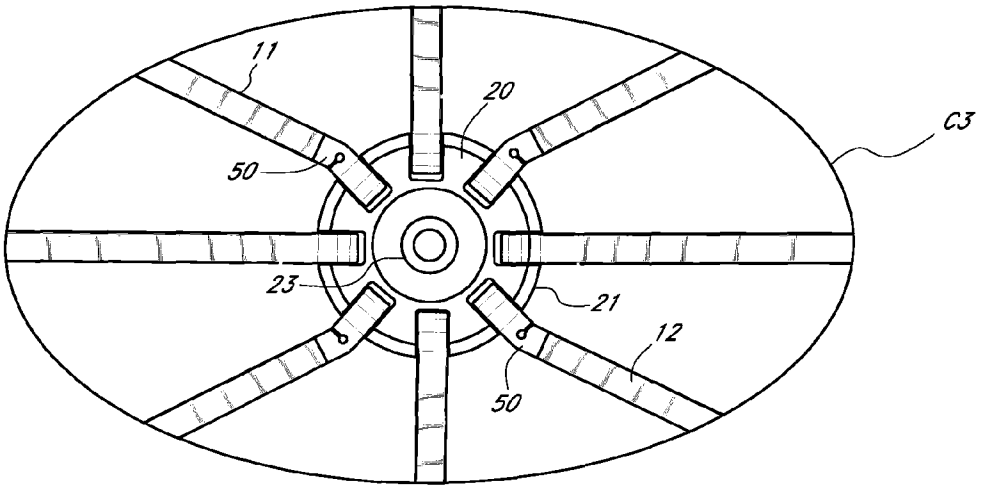
FIG. 4A is a bottom view of an upper portion of an umbrella illustrating an embodiment of the connectors in cooperation with an oval canopy.

FIG. 4 is a bottom view of an embodiment of an umbrella having an oblong canopy, such as for example a rectangular canopy. Similar to the embodiment of FIG. 3, eight hub channels 22 are spaced at equal angles around the hub periphery 21, in which case the angle $\alpha$ between the longitudinal axes 25 of the hub channels 22 is approximately 45 degrees. FIG. 4 further illustrates canopy ribs 12 that are coupled to the hub channels 22. Preferably, the canopy ribs 12 extend to desired positions on the periphery of the oblong canopy to provide optimum support for the oblong canopy. In order to reach the desired positions, such as for example the peripheral positions of an oval canopy C3 illustrated in FIG. 4A, or the corners of a rectangular canopy C4, as illustrated in FIG. 4B, some canopy ribs 12 can extend from the hub 20 at an angle relative to adjacent canopy ribs 12 that is different from the angle between adjacent longitudinal axis 25 of the hub channels 22. In some oblong arrangements, longitudinal axes 14 of some of the canopy ribs 12 are not collinear to the longitudinal axes 25 of the respective hub channels 22. In some oblong arrangements, the longitudinal axis 14 of at least one of the canopy ribs 12 forms a non-zero angle relative to the longitudinal axis 25 of the hub channels 22 to which the rib 12 is connected. In some embodiments, the angle $\beta$ between the longitudinal axes 14 of adjacent canopy ribs 12 is not equal to the angle $\alpha$ between the longitudinal axes 25 of adjacent hub channels 22. The difference in angle between angle $\alpha$ and angle $\beta$ is equal to $\gamma$, which represents the angle between the longitudinal axis 25 of the hub channels 22 and the longitudinal axis 14 of the canopy ribs 12.

The angular differences between the longitudinal axes 25 of the hub channels 22 and the longitudinal axes 14 of the canopy ribs 12 can be described in terms of the intersection points of the longitudinal axes. The longitudinal axes 25 of the hub channels 22 are oriented such that they converge toward the center of the hub 20. On the other hand, the longitudinal axes 14 of the canopy ribs 12 do not all converge toward a single common point. Rather the longitudinal axes 14 can have more than one point where they intersect. For example, as illustrated in the embodiment of FIG. 4, the two angled canopy ribs 12 on the right side of the hub 20 converge at a point to the left of the central aperture 23 of the hub 20. Also, the longitudinal axes 14 of the two angled canopy ribs 12 on the left side of the hub 20 converge at a point to the right side of the central aperture 23 of the hub 20. Similarly, any two longitudinal axes 14 of two canopy ribs 12 can converge at a point that may not coincide with other intersection points of other longitudinal axes 14.

As illustrated in FIG. 4, the connectors 50 are interposed between the canopy ribs 12 and hub channels 22 to provide angular adjustability and enable the canopy ribs 12 to reach the desired points on the periphery of the oblong canopy while properly connecting to the hub channels 22. The connector 50 can comprise certain features that enhance its adjustability and strength. In particular, such embodiments can provide various means for flexibly coupling a support rib 11 with the hub 20, the runner 26, or other structure. It is contemplated that the embodiments that use such features can provide for a connector that is superior to prior art connectors used with shade structures. For example, the connector 50 allows one standard hub design to be used with various canopy sizes and shapes. Any difference in angle between the angle of the hub channel 22 and the angle of the support ribs 11 as they extend to locations on, or adjacent to, the periphery of the canopy 15 can be accommodated by the adjustable connector 50. The adjustable connector 50 can advantageously eliminate the need for multiple hub designs that are customized for different canopy sizes and shapes.

Figure 5:
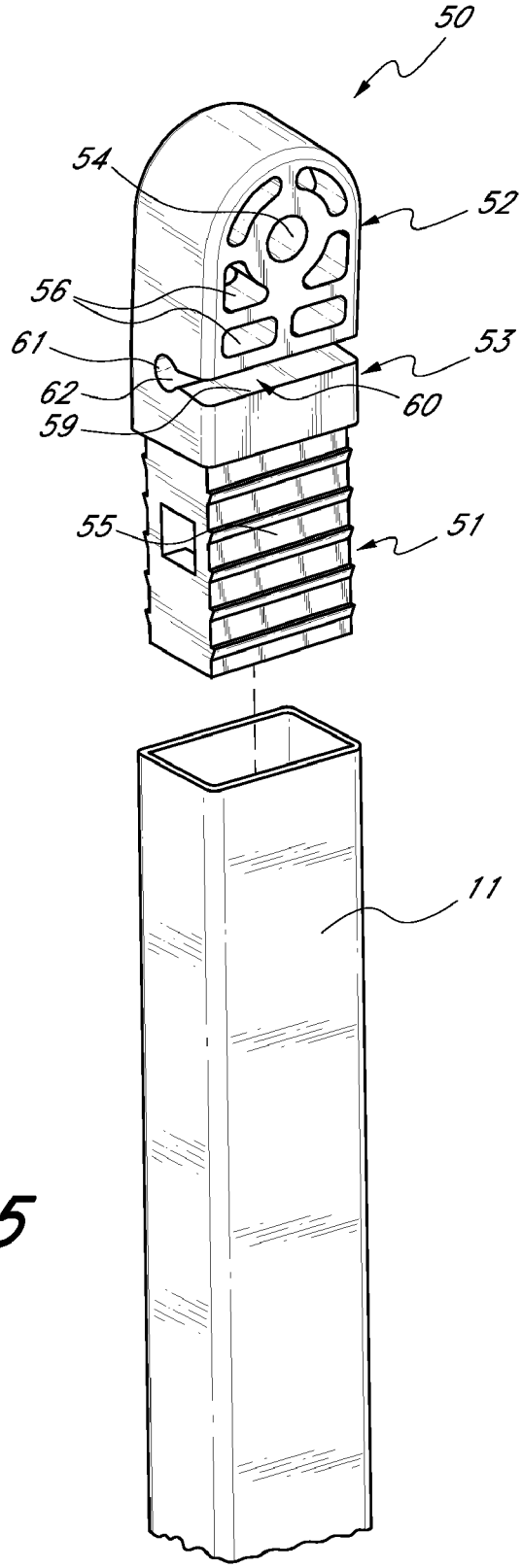
FIG. 5 is a perspective exploded view of a rib and connector assembly, in accordance with an embodiment.

FIG. 5 illustrates that in accordance with an embodiment, the connector 50 comprises a first portion 51, a second portion 52 and an adjustable portion 53 interposed between the first and second portions 51, 52. The first portion 51 is coupled with an end of one of the support ribs 11. The first portion 51 comprises a barbed structure 55 and the support rib 11 is substantially hollow at least toward the end that mates with the first portion 51 of the connector 50. The first portion 51 can slide into the hollow portion of the support rib 11 and secure to the inner walls of the support rib 11. An interference fit between the barbed structure 55 of the first portion 51 and the inner wall of the support rib 11 can hold the connector 50 to the support rib 11. In some embodiments, the first portion 51 of the connector 50 and the end of the support rib 11 can be connected using a press fit, pins, screws, adhesives or other means and methods known in the art.

In some embodiments, the barbed structure 55 can be oriented in one direction. As illustrated in FIG. 5, the barbed structure 55 can be configured so that the barbs are angled to allow the first portion 51 to easily slide in one direction into the support rib 11, but resist sliding out in the opposite direction. The angled barbed structure 55 can resist sliding in the opposite direction by pressing against the inner walls of the support rib 11 when the first portion 51 is pulled out from the support rib 11. This unidirectional barb configuration can allow for quick assembly while resisting inadvertent disassembly of the connector 50 and support rib 11.

Figure 7:
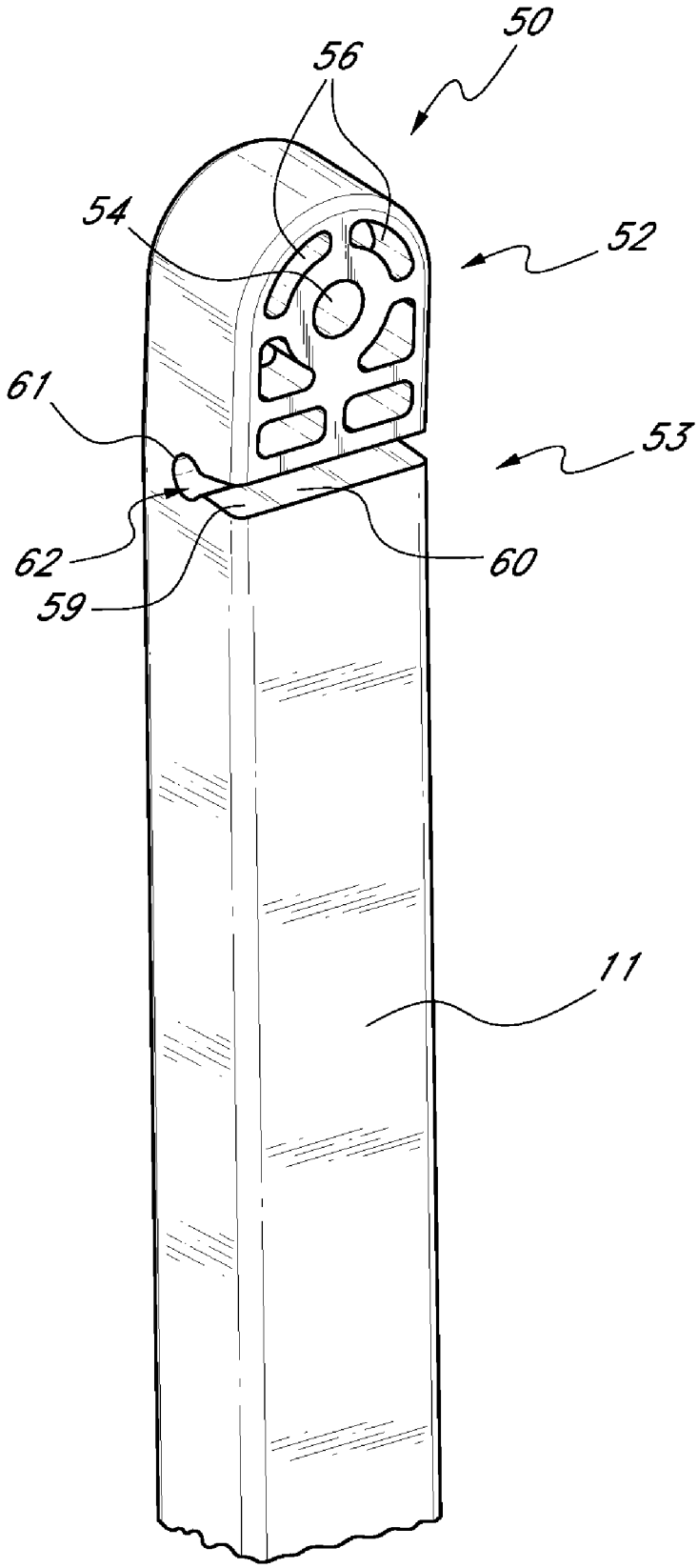
FIG. 7 is a perspective view of a connector that is integrally formed with a rib of the canopy support frame, in accordance with an embodiment.

In some embodiments, as illustrated in FIG. 7, the first portion 51 of the connector 50 can be integrally formed with one of the support ribs 11 or structural members, such that the connector 50 and the support rib 11 are formed from a single, continuous piece of material. These embodiments can advantageously provide a more rigid connector and support rib structure, while reducing the number of parts in the umbrella assembly and reducing manufacturing costs.

Figure 6:
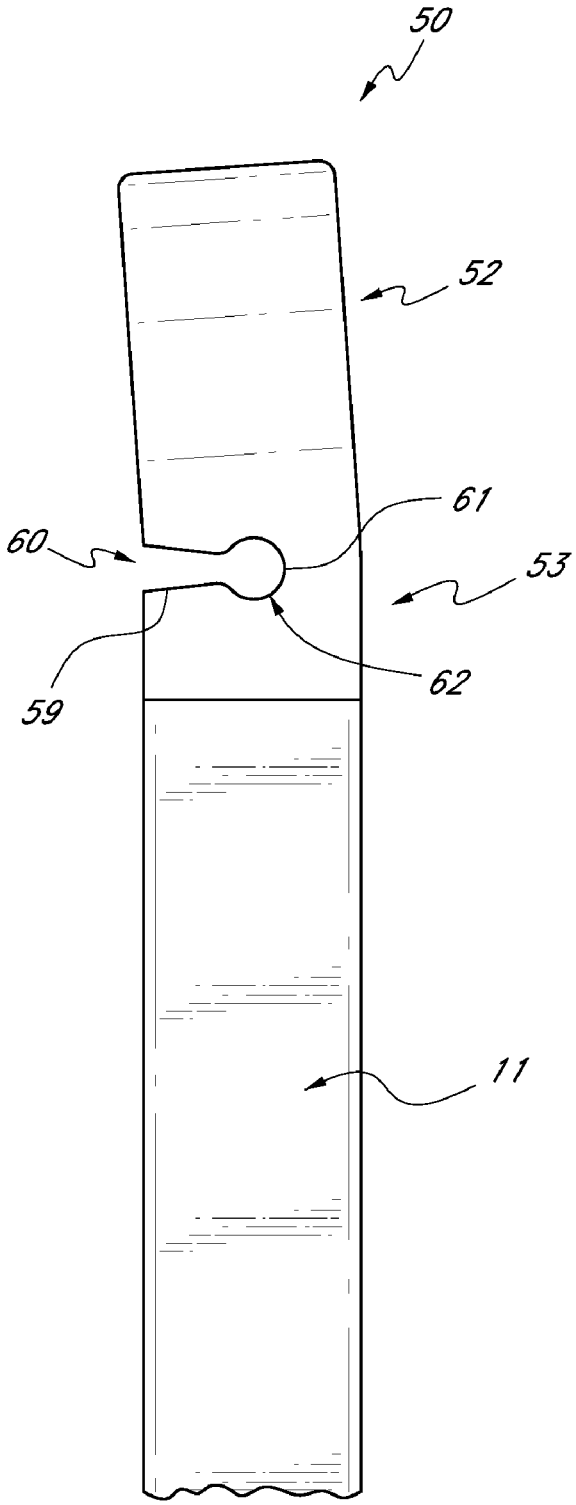
FIG. 6 is a side view of the connector coupled to an end of the rib illustrated in FIG. 5, with a first end portion at an angle relative to a second end portion.

With further reference to FIGS. 5-7, the support ribs 11 and the connectors 50 can define substantially rectangular cross-sections. In some embodiments, the connector 50 can be generally polygonal in its cross-section. However, it is contemplated that the cross-sections of the connector 50 and the support rib 11 can be of any shape, as desired, such as for example oval, circular or C-shaped.

Further, the second portion 52 of the connector 50 is configured to connect to a hub 20. As illustrated in FIGS. 3 and 4, the hub 20 comprises a plurality of hub channels 22 for accepting the second portions 52 of the connectors 50. In the embodiment illustrated in FIG. 5, the second portion 52 of the connectors 50 that attaches to the hub channels 22 comprises a bore 54 extending transversely through the connector 50 for receiving a pin 24 that is attached to the hub 20. The pins 24 are mounted transversely across the width of the hub channels 22 and are placed through the bore 54 to rotatably secure the connectors 50 to the hub 20.

In other embodiments, it is contemplated that the connector 50 can be coupled with the hub 20 in other configurations. For example, the connector 50 can be configured to provide a secure engagement with the hub 20 while allowing relative motion between the connector 50 and the hub 20, such as linear motion or otherwise. In some embodiments, the connector 50 can be rigidly coupled to the hub 20 such that the connector 50 and the hub 20 are fixed relative to each other. Although described with reference to coupling the connector 50 with the hub 20, the connectors 50 can be used to connect one support rib 11 to another support rib 11.

In other embodiments, the second portion 52 of the connectors 50 can comprise a hook shape that allows for quick connect and disconnect of the connectors 50 and pins 24. In some embodiments, the hook shaped connector 50 can additionally comprise a securing member to prevent inadvertent disassembly of the connectors 50 and the pins 24. Various embodiments of a quick connect and disconnect connectors 50 are disclosed in Applicant's co-pending U.S. patent application Ser. No. 11/849,222, entitled "Quick Connector for Shade Structure," the entirety of which is incorporated herein by reference. In still other embodiments, the second portion 52 can comprise other means of securing the connector 50 to the hub 20 that are commonly known in the art.

In some embodiments, the connectors 50 and hub 20 can be rigidly assembled together. The connectors 50 can be fastened or bonded to the hub 20 with, for example, screws, welding or adhesives. In these embodiments, the umbrella 10 or pavilion can be configured to remain in the open position.

The width of the connectors 50 is preferably only slightly smaller than the width of the hub channel 22 so that the connector 50 has a close fit with the hub channel 22. The amount of play between the connector 50 and the hub channel 22 can be minimized, which advantageously promotes a tight and secure coupling.

Figure 8:
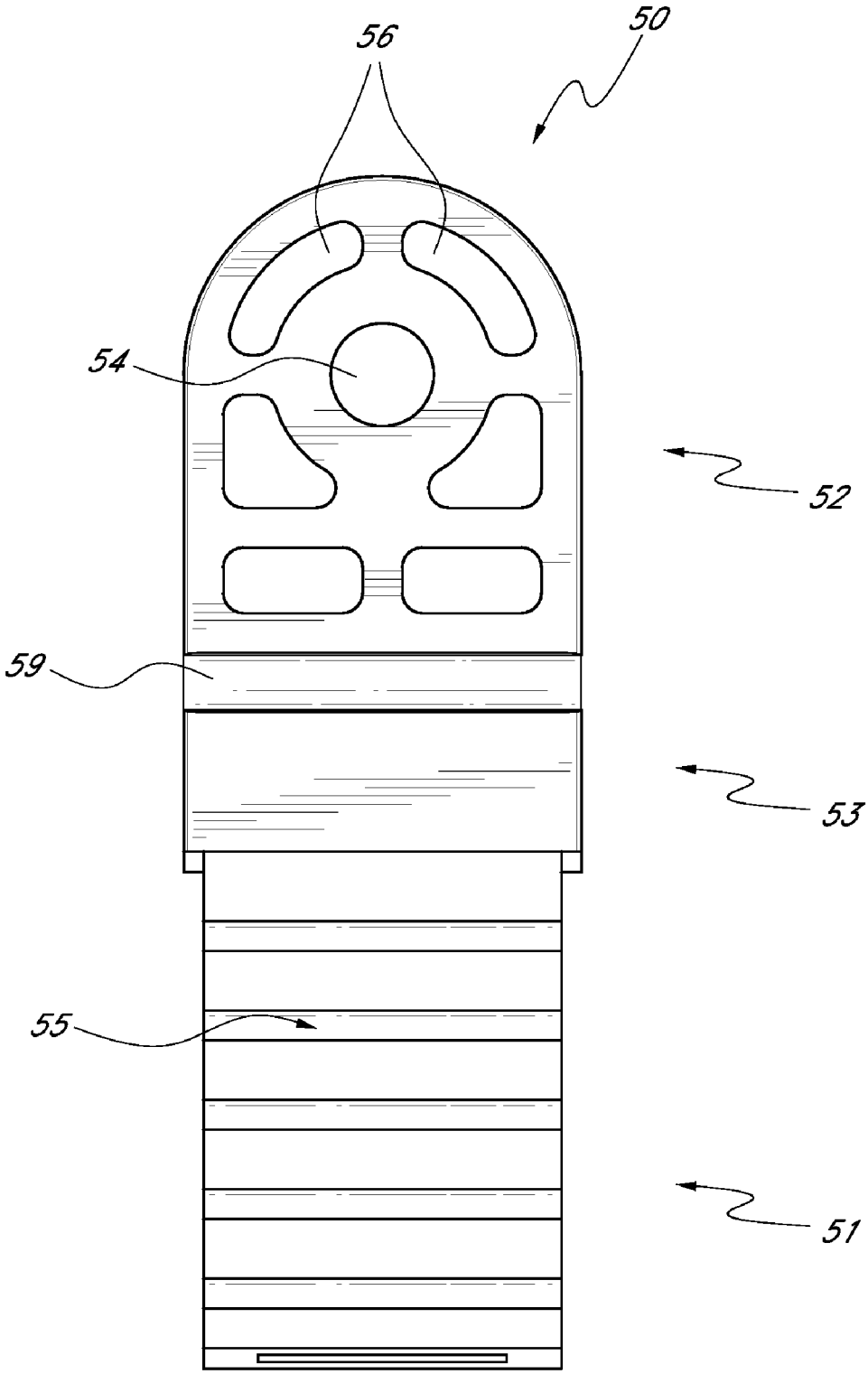
FIG. 8 is a front view of the connector illustrated in FIG. 5.

With reference to FIGS. 5 and 8, the second portion 52 can comprise a plurality of cavities 56 that can reduce the weight of the connector 50 while maintaining sufficient strength and rigidity. In the embodiment illustrated in the figures, both sides of the connector 50 comprise a plurality of cavities 56 that extend toward the middle of the connector 50, but do not extend through the entire width of the connector 50. However, in other embodiment, at least one of the cavities 56 can extend through the entire width of the connector 50. In some embodiments, the second portion 52 of the connector 50 may not have any cavities 56. In other embodiments, only a portion of the first portion 51 can have cavities 56 or through holes. In still other embodiments, only one side of the connector 50 can have cavities 56 that extend a partial width of the connector 50.

As illustrated in the embodiment of FIGS. 5 and 8, the end of the second portion 52 is rounded or chamfered to provide clearance so that the connector 50 can pivot within the hub channel 22 without interference with the hub 20. In other embodiments, the end of the second portion 52 may not be rounded or chamfered, such as for example a square end. In some embodiments, the end of the second portion 52 can have any shape that advantageously provides the connector 50 clearance as it pivots within the hub channel 22.

Figure 9:
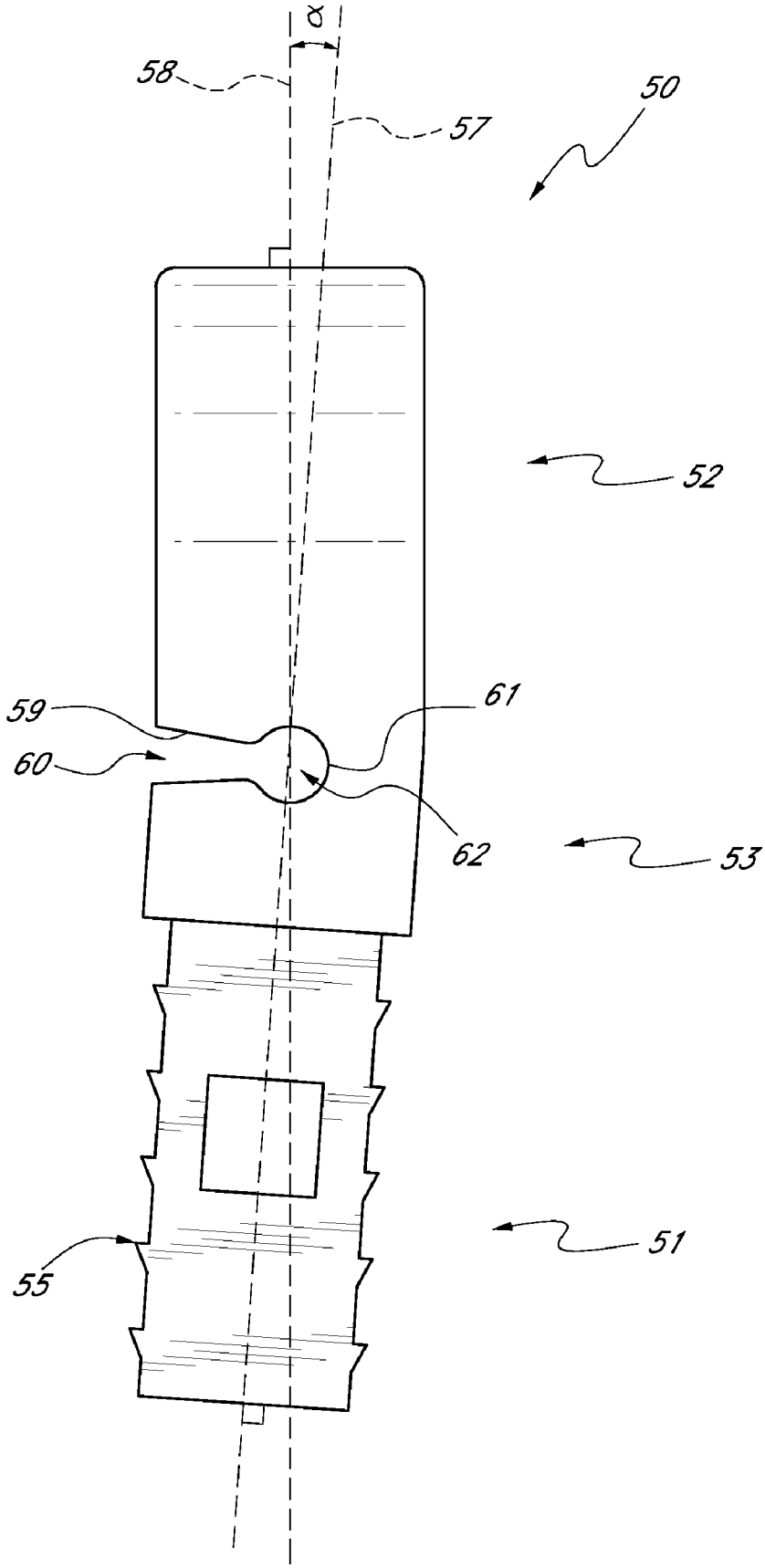
FIG. 9 is a side view of the connector illustrated in FIG. 5.
Figure 10:
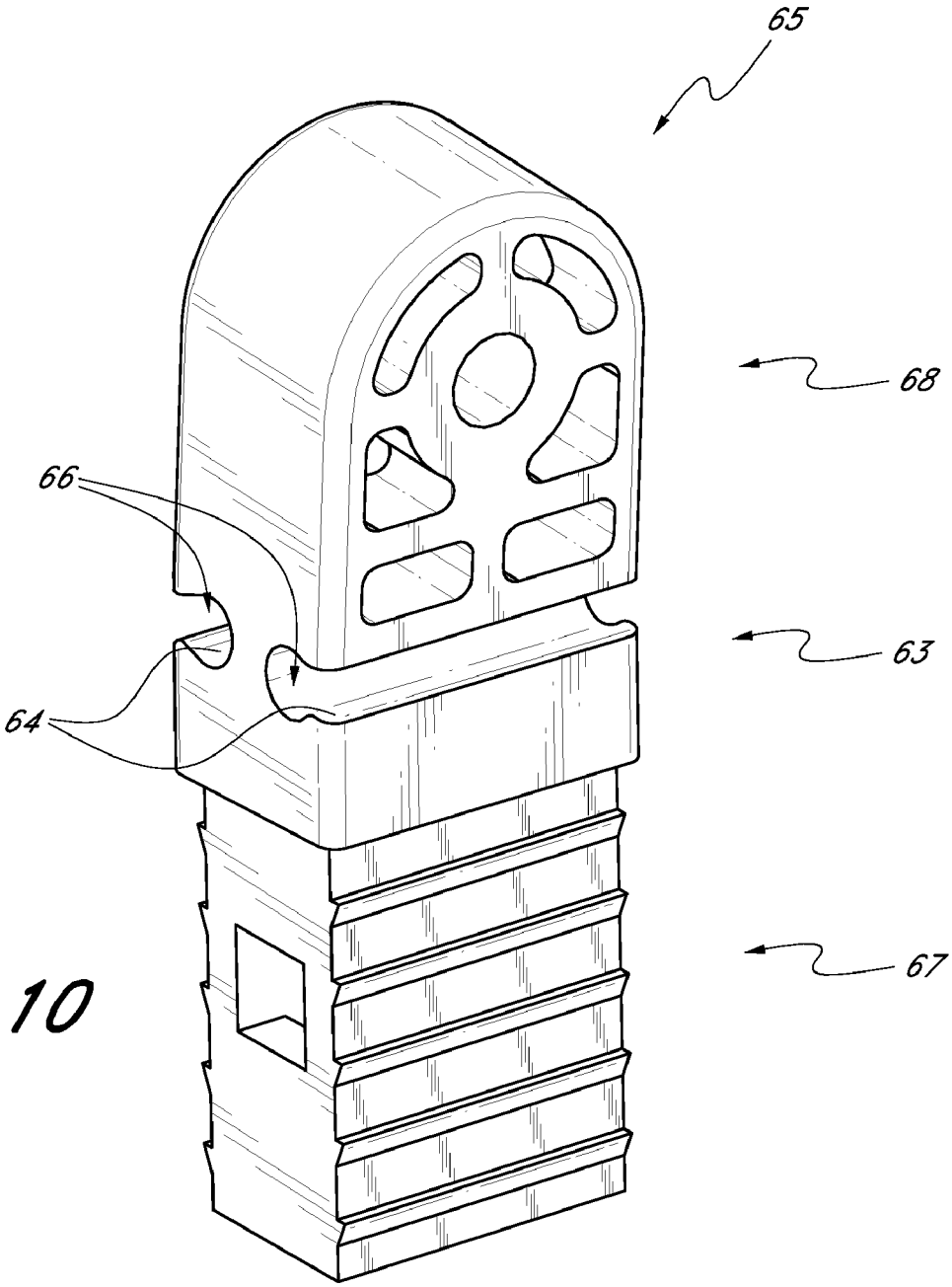
FIG. 10 is a perspective view of an embodiment of the connector having two channels.
Figure 11:
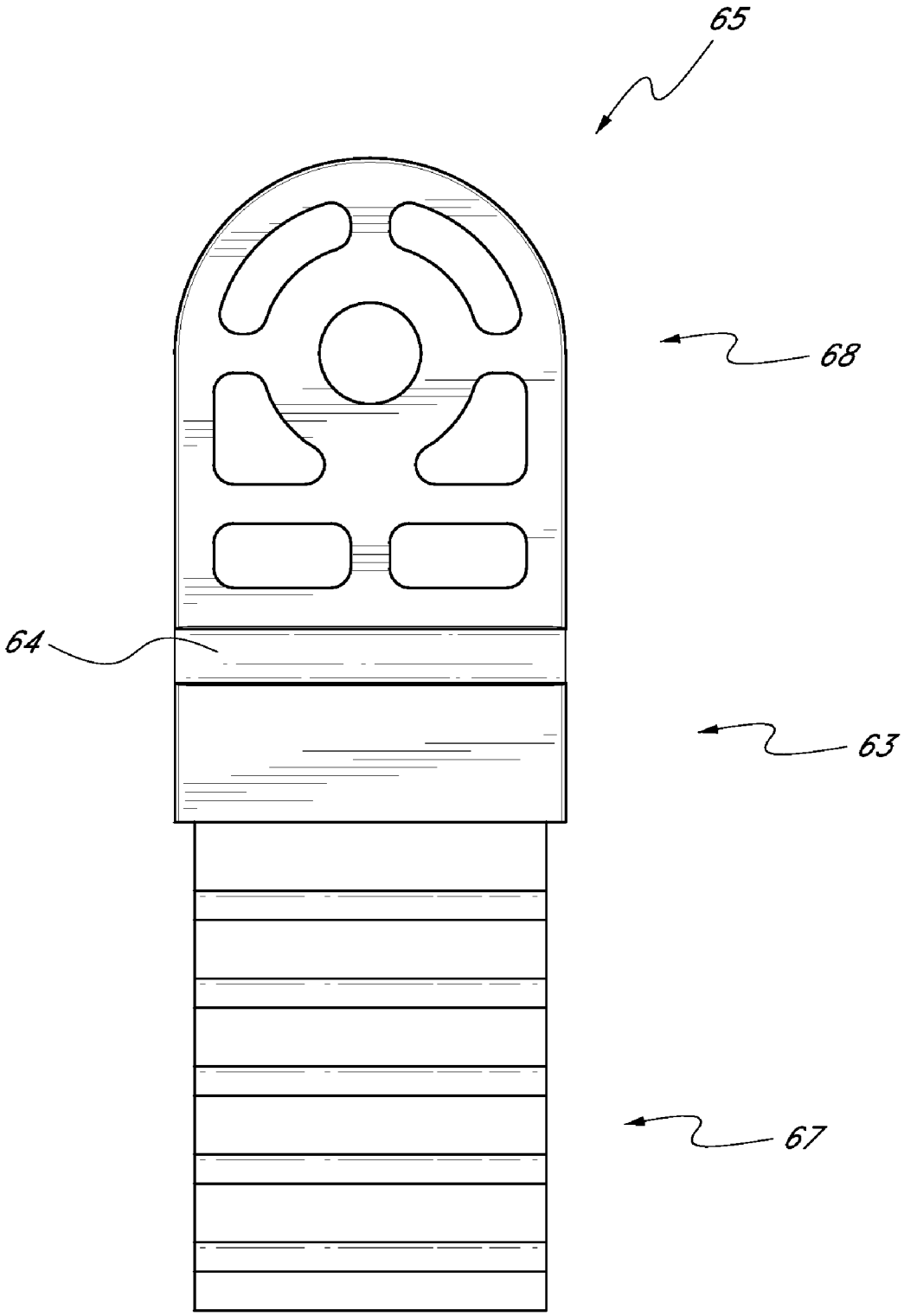
FIG. 11 is a front view of the connector illustrated in FIG. 10.

With reference to FIG. 9, a first longitudinal axis 57 is defined as a longitudinal axis that extends along the length of the first portion 51 and is normal to an end of the first portion 51. A second longitudinal axis 58 is defined as a longitudinal axis that extends along the length of the second portion 52 and is normal to an end of the second portion 52.

The adjustable portion 53 can be configured to allow the first longitudinal axis 57 to be at an angle to the second longitudinal axis 58. In some embodiments, the adjustable portion 53 can comprise at least one channel 59 that is disposed transversely to the length of and along a width of a side of the connector 50. The channel 59 has a depth extending from an opening 60 to a base end 61 of the channel 59 opposite the opening 60. In some embodiments, the base end 61 can be rounded such that the cross-sectional shape of the channel 59 is generally U-shaped. In other embodiments, the base end 61 can be squared such that the channel 59 has a flat base. In still other embodiments, the base end 61 can be any other shape. Preferably, the depth of the channel 59 extends to about the midpoint of the entire depth of the connector 50. In some embodiments, the walls of the channel 59 can be tapered inward, so that the width of the channel 59 decreases toward the base end 61 of the channel 59 compared to the width at the opening 60. In other embodiments, the walls of the channel 59 can taper outward so that the width of the channel 59 is larger at the base end 61 of the channel 59 compared to the width at the opening 60. In some embodiments, a portion of the walls of the channel 59 can taper inward while another portion of the walls of the channel 59 can taper outward. In still other embodiments, the walls of the channel 59 can be straight so that the width of the channel 59 is generally constant from the opening 60 to the base end 61 of the channel 59.

As illustrated in FIGS. 6 and 9, the base end 61 of the channel 59 can have an enlarged portion 62. In the illustrated embodiments, the enlarged portion 62 has a cross section that is substantially circular in shape, such that the cross-sectional shape of the channel 59 is generally key-hole shaped. In other embodiments, the enlarged portion 62 can have a cross section that is any shape, such as for example square, triangle, polygon or oval. Embodiments having a single channel 59 are advantageous for bending in the direction toward the side where the opening 60 of the channel 59 is facing.

Figures 12A, 12B:
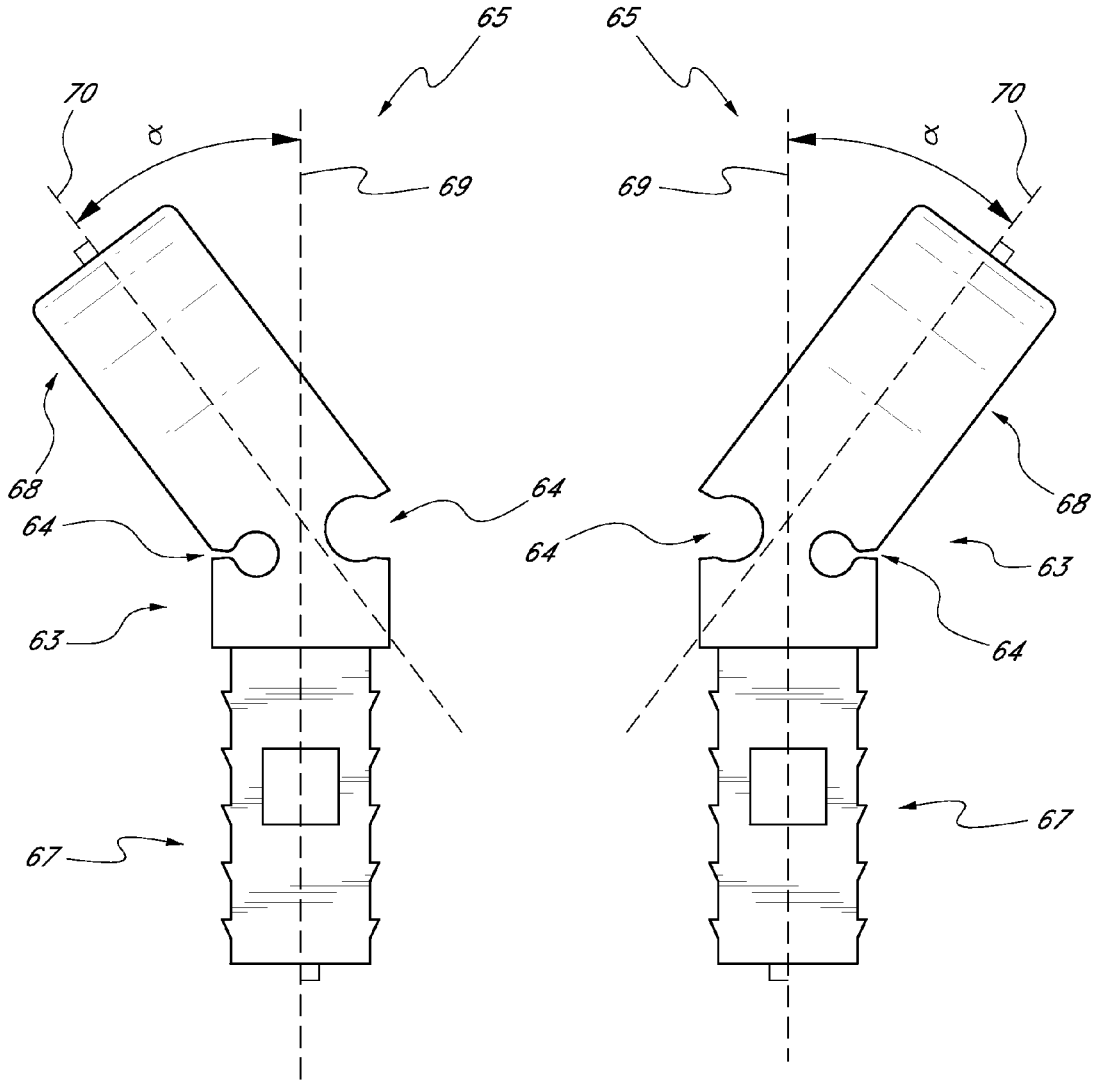
FIG. 12A is a side view of the connector illustrated in FIG. 10 angled in a first direction.
FIG. 12B is a side view of the connector illustrated in FIG. 10 angled in a second direction.

As illustrated in FIGS. 10-12B, the adjustable portion 63 can comprise two channels 64 that are disposed on opposite sides of the connector 50. The depths of the channels 64 can extend toward each other without joining, so that a section of material is disposed between the channels 64. As described above for the embodiments with a single channel, the walls of the channels 64 can be straight or taper inward or outward. Preferably, the base ends of the channels 64 have enlarged portions 66 to provide two key-hole shaped channels, as described above. Embodiments having two channels 64 on opposite sides of the connector 50 are advantageous for bending in both directions where the channels 64 are disposed, as illustrated in FIGS. 12A and 12B.

FIG. 12A illustrates a side view of an embodiment of a connector 65 having two channels 64 that are configured to enhance adjustability of the connector. The connector has a first portion 67 that is configured to be connected to a rib 11 and a second portion 68 that is configured to connect with the hub 20 or the runner 26. FIG. 12A illustrates that the channels 64 enable the adjustable portion 63 of the connector 65 to be angled in a first direction, such that the longitudinal axes 69, 70 of the first portion 67 and the second portion 68, respectively, are disposed at an angle γ. FIG. 12B illustrates another side view of the connector 65 angled in a second direction, such that the longitudinal axes 69, 70 of the first and second portions 67, 68 are disposed at an angle γ.

In some embodiments, the adjustable portion 53 can comprise a hinge instead of a channel 59. The hinge can be configured to allow the connector 50 to pivot in one direction, similar to a connector 50 having one channel 59. In other embodiments, the hinge can be configured so that the connector 50 can pivot in two directions, similar to a connector 50 having two channels 63.

In still other embodiments, the adjustable portion 53 can comprise an elastomeric material. The elastomeric material can be flexible and allow the connector 50 to pivot about the elastomeric material. In some embodiments, other portions of the connector 50, in addition to the adjustable portion 53, can be composed of an elastomeric material so that other portions of the connector 50 can bend or pivot.

While the embodiments shown in the figures refer to support ribs 11, other types of structural members can also be used. In this regard, the embodiments disclosed herein can be used not only with support ribs 11 or bar-like structural members, but also with plates, trusses, braces, joints, or other portions of a structure.

In some embodiments, the connector 50 can comprise of any material that can provide flexibility. For example, the connector 50 can be at least partially made of a flexible plastic, rubber, polymer, pliable wood, or other flexible material. The connector 50 can also comprise of a flexible metal such as spring steel. In some embodiments, the adjustable portion 53 can be made of the flexible material. In other embodiments, other portions of the connector 50 can also be made of the flexible material.

In order for the connector 50 to adjust the angle at which the support ribs 11 extend, the adjustable portion 53 is preferably disposed outside of the hub channel 22, as best illustrated in FIGS. 3 and 4. In other words, in the assembled configuration, the distance from the adjustable portion 53 of the connector 50 to the bottom of the hub channel 22 should be greater than the length of the hub channel 22, measured from the hub periphery 21 of the hub channel 22 to the bottom of the hub channel 22.

As mentioned above, the adjustable connector 50 advantageously enables one, standardized hub design to be used on umbrellas with non-oblong as well as oblong canopies. Such novel connectors 50 can be particularly advantageous for reducing manufacturing costs and enhancing interchangeability of parts, particularly hubs 20. The adjustable connector 50 can also advantageously adjust for manufacturing inconsistencies or defects that may require the support ribs 11 to extend at a different angle than the angle of the hub channels 22. For example, a hub for a non-oblong canopy 15 may be manufactured incorrectly wherein one of the hub channels 22 is not equiangular with the other hub channels 22. The adjustable connector 50 can be used with this hub to correct the defect and couple the support ribs 11 to the hub channels 22.

In this regard, it is noted that the umbrella 10 is not the only structure with which the connectors 50 can be used. The connectors 50 can also be used with pavilions, and other shade structures, as well as tables, display stands, and other such structures that utilize interconnecting members, and in some instances, can be assembled into an expanded state from a collapsed state in order to make beneficial use of the structure. Therefore, although the connectors 50 are illustrated as being used with an umbrella 10, the connectors 50 can be used with any variety of other structures.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella having an open, in use, position and a closed, stowed, position, the umbrella comprising:

a pole;

a hub having a periphery extending around the pole, the hub periphery having formed therein a plurality of radially outwardly oriented hub channels that are spaced at a first angle from one another around the hub periphery, wherein the first angle between each pair of adjacent hub channels is the same around the hub periphery;

a canopy having a periphery that includes at least some points located at different distances from the pole in the open position;

a plurality of ribs, each being mounted in a respective hub channel and extending from the respective hub channel to the periphery of the canopy, said ribs comprising a first group extending from the hub along longitudinal axes that are collinear with a radial orientation of the respective hub channels and a second group extending away from the hub along longitudinal axes that deviate from the radial orientation of the respective hub channels to points on the periphery of the canopy, and a plurality of connectors comprising a first portion coupled with at least some of the ribs, a second portion coupled with the hub, and a flexible portion disposed between the first and second portions configured to allow the ribs to deviate from the radial orientation of the respective hub channels;

wherein the flexible portion comprises two channels on opposite sides of the connector, each channel disposed transversely to one side of the connector.

2. The umbrella in claim 1, wherein at least one of the channels is enlarged at the base end.

3. The umbrella in claim 1, wherein a width of the second portion of at least one of the plurality of connectors is substantially the same as a width of the respective hub channel.

4. The umbrella in claim 1, wherein a distance from the flexible portion of the connector to a bottom of the respective hub channel is greater than a length of the respective hub channel.

5. The umbrella in claim 1, wherein the canopy comprises an oblong shape.

6. The umbrella in claim 1, wherein the canopy comprises a rectangular shape.

7. The umbrella in claim 1, wherein the canopy comprises an oval shape.

8. The umbrella in claim 1, wherein the umbrella is configured such that each rib of the second group can be adjusted in orientation about a pivot axis having a component that is parallel to a longitudinal axis of the pole.

9. The umbrella in claim 1, wherein each of the ribs of the second group has a first portion that extends along or parallel to the radial orientation of the respective hub channel and a second portion that extends along a longitudinal axis that deviates from the radial orientation of the respective hub channel.

* * * * *